US007286052B2

(12) United States Patent
DiPoala

(10) Patent No.: US 7,286,052 B2
(45) Date of Patent: Oct. 23, 2007

(54) DETECTOR WITH BLINDERS

(75) Inventor: William S DiPoala, Fairport, NY (US)

(73) Assignee: Robert Bosch GmbH, Stuttgart (DE)

( * ) Notice: Subject to any disclaimer, the term of this patent is extended or adjusted under 35 U.S.C. 154(b) by 186 days.

(21) Appl. No.: 11/104,724

(22) Filed: Apr. 13, 2005

(65) Prior Publication Data

US 2005/0231352 A1 Oct. 20, 2005

Related U.S. Application Data

(60) Provisional application No. 60/562,163, filed on Apr. 14, 2004.

(51) Int. Cl.
*G08B 13/00* (2006.01)

(52) U.S. Cl. ..... 340/541; 340/540; 340/521; 340/523; 340/511; 340/555; 340/556; 702/62

(58) Field of Classification Search ..... 340/541, 340/540, 521, 523, 511, 555, 556; 702/62
See application file for complete search history.

(56) References Cited

U.S. PATENT DOCUMENTS 5,567,942 A 10/1996 Lee et al. ..... 250/353
5,703,368 A 12/1997 Tomooka et al. ..... 250/349
5,739,753 A 4/1998 Porter ..... 340/555
6,697,757 B2 * 2/2004 Eckel et al. ..... 702/130
6,987,267 B1 1/2006 Monroe et al. ..... 250/342

FOREIGN PATENT DOCUMENTS

DE 295 03 532 U1 5/1995

OTHER PUBLICATIONS

European Search Report mailed May 18, 2005.

* cited by examiner

*Primary Examiner*—Tai Nguyen
(74) *Attorney, Agent, or Firm*—Baker & Daniels LLP

(57) ABSTRACT

A detector mountable on either a planar wall or an interior corner and having an adjustable field of view. The detector includes first and second sensors positioned to provide a horizontal field of view defining an angle of approximately 180 degrees. At least one blinder has a first position wherein the first and second sensors have a horizontal field of view defining an angle of approximately 180 degrees and a second position wherein the first and second sensors have a horizontal field of view defining an angle of approximately 90 degrees. A biasing member biases the blinder toward a first one of the first and second positions. A positioning member has a first member position wherein the positioning member biases the blinder toward the other of the first and second positions and a second member position wherein the biasing member biases the blinder into the first one of the first and second positions.

17 Claims, 6 Drawing Sheets

DETECTOR WITH BLINDERS

CROSS REFERENCE

This application claims the benefit of Provisional Patent Application No. 60/562,163, filed on Apr. 14, 2004.

BACKGROUND OF THE INVENTION

1. Field of the Invention

The present invention relates to motion detection systems and, more particularly, passive infrared motion detectors that have an adjustable field of view to facilitate their mounting in either a corner or on a wall.

2. Description of the Related Art

Passive infrared (PIR) motion detectors are well known in the art and are used to detect the presence of a human intruder by sensing the thermal energy radiated by the intruder. Generally, such PIR detectors are designed to have a horizontal field of view that has an angular range of between 85 and 90 degrees. Using this range for the field of view allows the detector to be mounted in an interior corner. By utilizing a horizontal field of view that is slightly less than 90 degrees, false alarms caused by objects on the adjacent walls can be reduced.

Oftentimes, it is desirable to mount detectors on planar walls rather than interior corners. Unfortunately, the corner-adapted detectors have a horizontal field of view of only 90 degrees. As a result, when mounted on planar walls, such detectors fail to provide coverage in the areas to the side of the detector. Accordingly, detectors having a 180 degree field of view have been proposed. Although effective for wall mounting, these detectors are not effective in interior corner mount situations. The 180 degree field intersects the walls forming the interior corner and, therefore, detects changes in thermal energy of objects on the walls. Objects on the wall, such as windows, curtains and blinds, often experience a significant change in thermal energy as the sun heats these objects. Such changes in thermal energy can be detected by the 180 degree, corner-mounted detector creating false alarms. Consequently, a need remains for an improved detector that may be effectively used in either corner and wall mounting applications and which includes a means for properly adjusting the field of view of the detector and inhibiting the incorrect installation of the detector.

SUMMARY OF THE INVENTION

The present invention provides a detector capable of being mounted on either a planar wall or an interior corner and having an adjustable field of view.

The invention comprises, in one form thereof, an intrusion detection system that includes first and second sensors, each of the first and second sensors having a horizontal field of view of approximately 90 degrees. A housing is also included and the first and second sensors are mounted within the housing wherein a portion of the housing is moveable relative to at least one of the first and second sensors to thereby define first and second relative positions wherein when the housing portion and the first and second sensors are in the first relative position the first and second sensors define a combined horizontal field of view of approximately 180 degrees and wherein when the housing portion and the first and second sensors are in the second relative position the first and second sensors define a combined horizontal field of view of approximately 90 degrees. A biasing member biases the first and second sensors and the housing portion towards one of the first and second relative positions.

The first and second sensors may be fixedly mounted relative to each other with the housing portion defining at least one moveable blinder. Alternatively, the first and second sensors may be relatively moveable and, in the first relative position, the horizontal fields of view of the first and second sensors are substantially overlapping and, in the second relative position, the horizontal fields of view of the first and second sensors are substantially non-overlapping.

The invention comprises, in another form thereof, an intrusion detection system that includes first and second sensors wherein each of the first and second sensors have a horizontal field of view of approximately 90 degrees. A housing is included and the first and second sensors are mounted within the housing wherein a portion of the housing is moveable relative to at least one of the first and second sensors to thereby define first and second relative positions wherein, when the housing portion and the first and second sensors are in the first relative position, the first and second sensors define a combined horizontal field of view of approximately 180 degrees and wherein, when the housing portion and the first and second sensors are in the second relative position, the first and second sensors define a combined horizontal field of view of approximately 90 degrees. A positioning member is also included. Movement of the positioning member positively positions the first and second sensors and the housing portion in a selected relative position to thereby define a selected horizontal field of view. In some embodiments, a biasing element is included which biases the first and second sensors and the housing portion towards one of the first and second relative positions. The first and second sensors and the housing portion may also be positionable between the first and second relative positions to thereby define a horizontal field of view between 90 and 180 degrees.

The invention comprises, in one form thereof, an intrusion detection system including first and second sensors positioned to provide a horizontal field of view defining an angle of approximately 180 degrees. The detection system also includes at least one blinder having a first position wherein the first and second sensors have a horizontal field of view defining an angle of approximately 180 degrees and a second position wherein the first and second sensors have a horizontal field of view defining an angle of approximately 90 degrees. A biasing member biases the blinder toward a first one of the first and second positions. A positioning member having a first member position and a second member position biases the blinder toward the other of the first and second positions when in the first member position while the biasing member biases the blinder into the first one of the first and second position when the positioning member is in the second member position.

The detection system may also include a housing mountable to either an interior corner or a planar wall. The housing has a first set of attachment features used when securing the housing to a planar wall and a second set of attachment features used when securing the housing to an interior corner. The securement of the housing to a planar wall using the first attachment features disposes the positioning member in one of the first member position and the second member position. The securement of the housing to an interior corner using the second attachment features disposes the positioning member in the other of the first member position and the second member position.

In another form, the detection system includes first, second and third sensors. Each of the first and second sensors have a downwardly directed line of sight and are positioned to provide a horizontal field of view defining an angle of approximately 180 degrees. The third sensor has a line of sight oriented substantially horizontally and has a horizontal field of view defining an angle of approximately 90 degrees. At least one blinder is provided and has a first position wherein the third sensor has a substantially unobstructed horizontal field of view while the first and second sensors have a horizontal field of view defining an angle of at least about 180 degrees, and a second position wherein the third sensor has a substantially unobstructed horizontal field of view while the first and second sensors have a horizontal field of view defining an angle of approximately 90 degrees.

The invention comprises, in yet another form thereof, a method of adjusting the detection field of an intrusion detection system. The method includes providing a first sensor and a second sensor, each of the first and second sensors having a horizontal field of view of approximately 90 degrees, the first and second sensors disposed within a housing and wherein the first and second sensors and the housing are relatively positionable to define a first horizontal field of view of approximately 90 degrees and a second horizontal field of view of approximately 180 degrees. The method also includes mounting the housing in one of a first and second location, the first location being in a corner and the second location being on a planar wall and positioning the first and second sensors and housing to define a horizontal field of view of approximately 90 degrees when the housing is mounted the first location and positioning the first and second sensors and housing to define a horizontal field of view of approximately 180 degrees when the housing is mounted in the second location. The method may also include generating an alarm signal when one of the first and second sensors detects an intruder.

An advantage of the present invention is that it provides a single detector that can be mounted in either a corner or on a planar wall wherein the horizontal field of view of the detector is easily adjusted to account for the two different mounting options. Moreover, the present invention also inhibits the installation of the device with the improper horizontal field of view.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
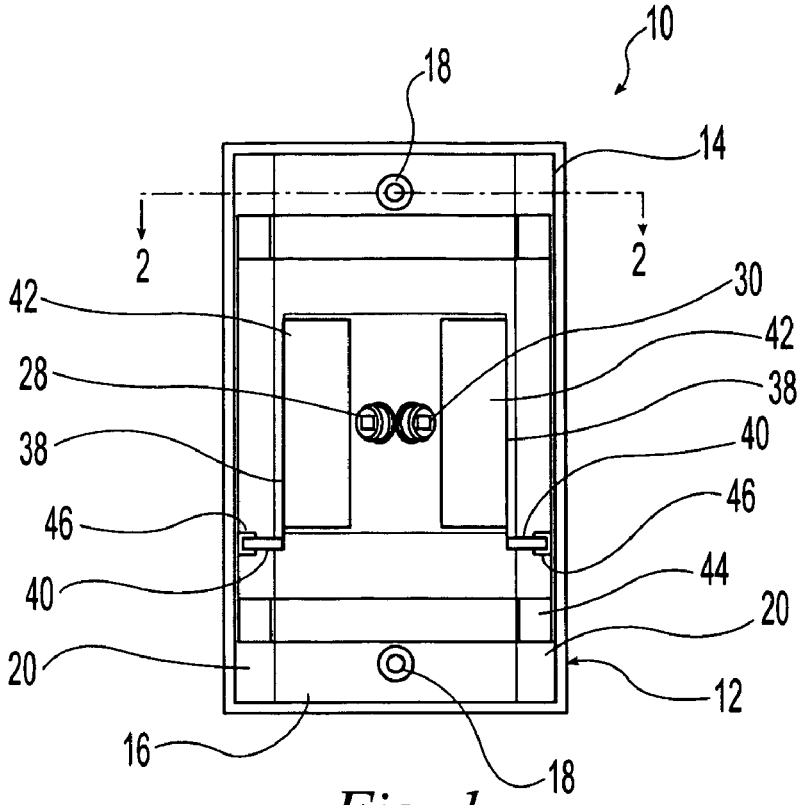
FIG. 1 is a front view of a detector with blinders according to one embodiment of the present invention, wherein the blinders are in a first position.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Figure 2:
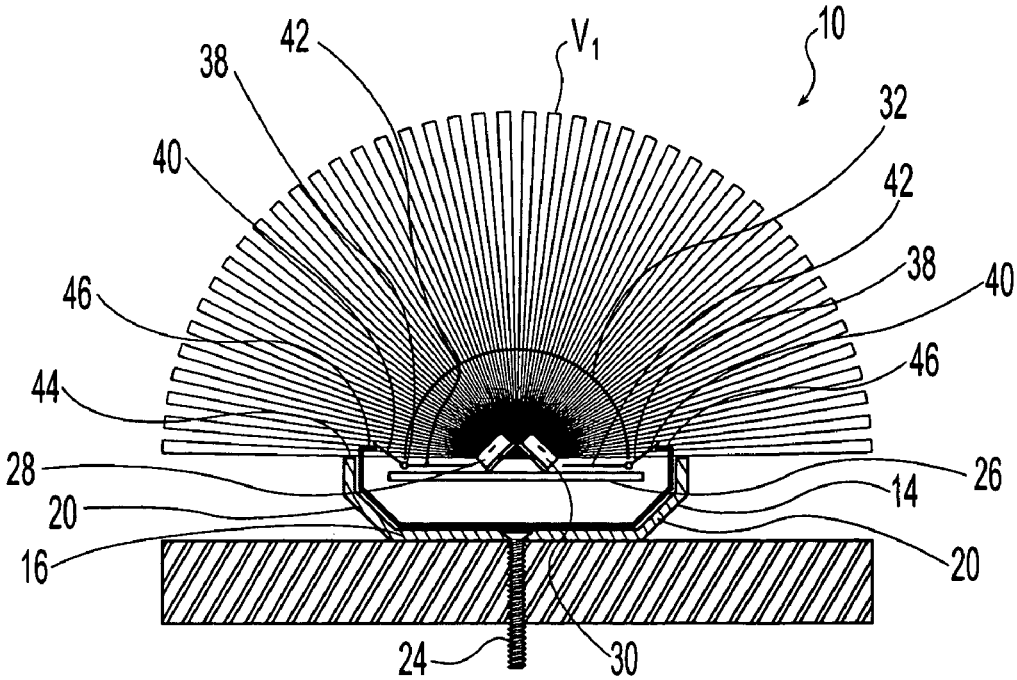
FIG. 2 is a sectional view, taken along lines 2-2, of the detector of FIG. 1 mounted on a planar wall.
Figure 3:
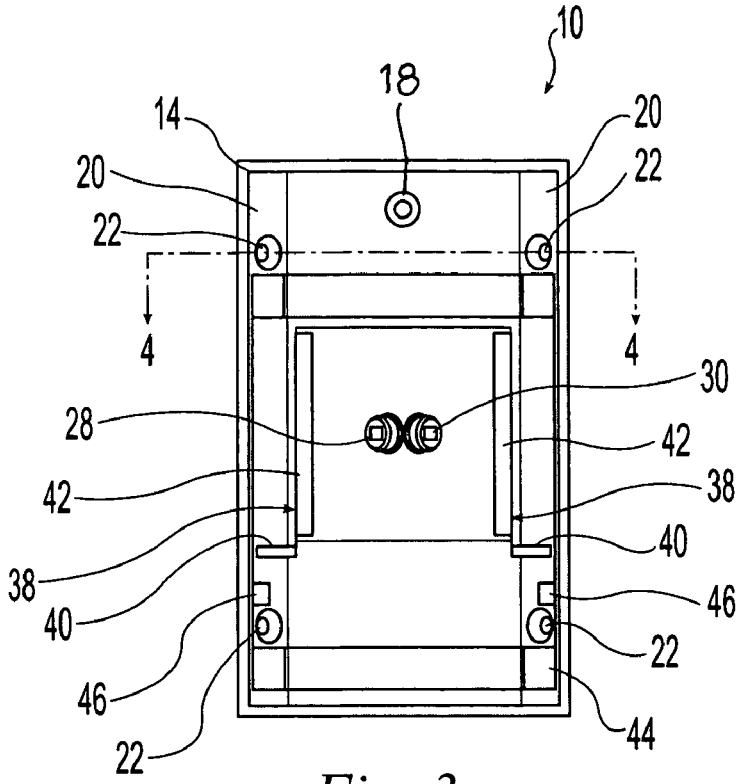
FIG. 3 is a front view of the detector of FIG. 1, wherein the blinders are in a second position.
Figure 4:
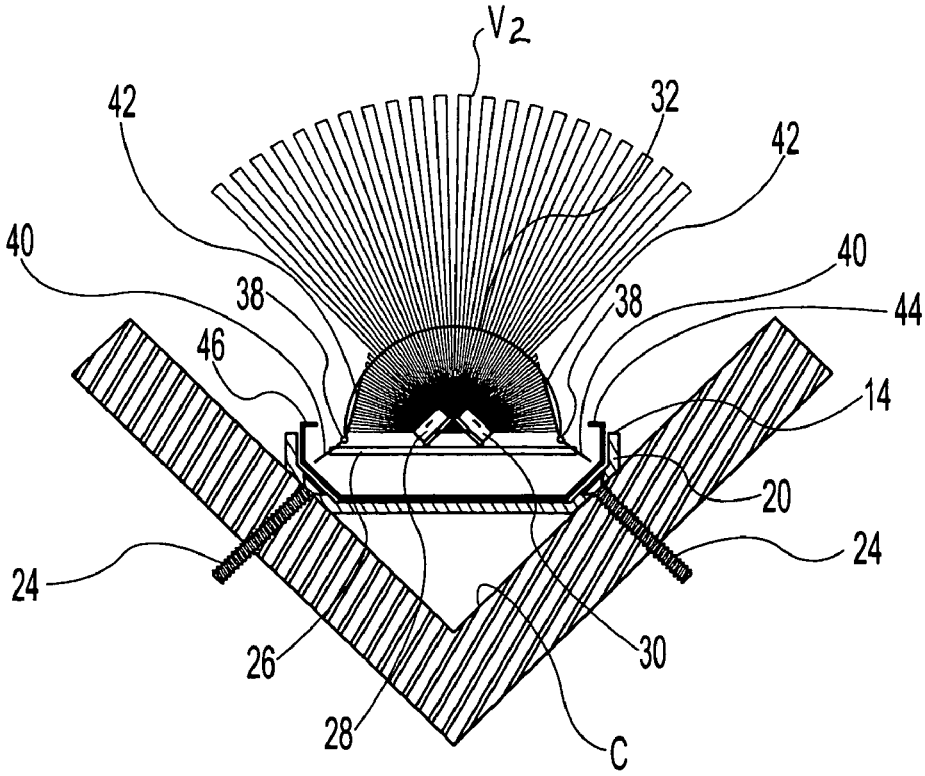
FIG. 4 is a sectional view, taken along lines 4-4, of the detector of FIG. 3 mounted on an interior corner.

Referring first to FIGS. 1-4, detector 10, in accordance with one embodiment of the present invention, includes housing 12 mountable to either an interior corner C, as shown in FIG. 4, or a planar wall W, as shown in FIG. 2. Housing 12 includes mounting base 14 defining a first set of attachment features for mounting housing 12 to planar wall W and a second set of attachment features for mounting housing 12 to interior corner C. Referring particularly to FIGS. 1 and 2, the first set of attachment features defined in mounting base 14 includes backplate portion 16 and a first set of openings 18 defined in backplate portion 16. As shown in FIG. 2, fasteners 24 extend through openings 18 and engage wall W to secure backplate portion 16 flushly against wall W. Referring particularly to FIGS. 3 and 4, the second set of attachment features defined in mounting base 14 includes a pair of angled sideplate portions 20 extending from opposite ends of backplate portion 16 and a second set of openings 22 defined in sideplate portions 20. As shown in FIG. 4, fasteners 24 extend through openings 22 and engage the walls forming interior corner C to secure detector 10 to corner C.

Referring back to FIGS. 1-4, detector 10 also includes printed circuit board 26 disposed within housing 12. First and second sensors 28, 30 are mounted on and are operatively linked to circuit board 26. In one particular embodiment, first and second sensors 28, 30 are passive infrared (PIR) sensors each having a horizontal optical field of view defining an angle of approximately 90°. First and second sensors 28, 30 are positioned adjacent to, and at an angle to, one another to provide a combined horizontal optical field of view $V_1$ defining an angle of approximately 180°, as shown in FIG. 2. A Fresnel lens 32 is positioned over both first and second sensors 28, 30 and is adapted to provide first and second sensors with multiple sections of view. Alternative embodiments may use other suitable sensors, lenses, mirrors, and/or other means for focusing thermal energy on the PIR sensors.

Referring still to FIGS. 1-4, blinders 38 are pivotally mounted adjacent printed circuit board 26 and are positioned on either side of the pair of sensors 28, 30. Each blinder 38 includes an actuating portion 40 and a blinding portion 42. Blinders 38 are pivotal between a first non-blinding position, shown in FIGS. 1 and 2, and a second blinding position, shown in FIGS. 3 and 4. In the first non-blinding position, shown in FIGS. 1 and 2, blinders 38 are pivoted inward toward circuit board 26 such that blinding portion 42 of each of blinders 38 lies adjacent to and parallel with circuit board 26. In this first position, blinding portion 42 of each of blinders 38 is positioned outside of the combined horizontal field of view of first and second sensors 28, 30, thus allowing sensors 28, 30 to provide an unrestricted horizontal field of view $V_1$ of approximately 180°. In the second position, shown in FIGS. 3 and 4, blinders 38 are pivoted outward away from circuit board 26 such that blinding portions 42 of each of blinders 38 projects outwardly from circuit board 26. In this second position, blinding portion 42 is positioned within the field of view of first and second sensors 28, 30, thus blinding a portion of the field of view and producing a reduced field of view $V_2$ of approximately 90°. Blinders 38 are biased to the second blinding position by a biasing member (not shown). The biasing member may be any suitable form such as a torsional spring mounted at the pivot point of blinders 38.

Referring still to FIGS. 1-4, positioning member or actuating member 44 is slidingly disposed within housing 12 and includes actuating flange 46. Actuating member 44 slides between a first member position, shown in FIGS. 1 and 2, and a second member position, shown in FIGS. 1 and 4. In the first member position, shown in FIGS. 1 and 2, actuating member 44 is positioned to expose first set of openings 18, while covering the second set of openings 22. Further, in this first member position, actuating flange 46 of actuating member 44 is in cooperative engagement with actuating portion 40 of blinders 38. This cooperative engagement between actuating portion 40 of blinders 38 and actuating flange 46 of actuating member 44 causes blinders 38 to pivot to the first position. In the second member position, shown in FIGS. 3 and 4, actuating member 44 is positioned to expose the second set of openings 22, while covering at least one of the first set of openings 18. Further, in this second member position, actuating flange 46 of actuating member 44 is released from its cooperative engagement with actuating portion 40 of blinders 38, thereby allowing the biasing member to bias blinders 38 to the second blinding position. The cooperative engagement may be any form suitable for causing actuating flange 46 to affect the pivoting of blinders 38. For instance, each of actuating flange 46 and actuating portion 40 may define cooperating camming surfaces which cooperate with one another to effect the pivoting of blinders 38. (In alternative embodiments, the biasing member may be omitted and the interaction between blinders 38 and actuating member 44 may be such that the position of actuating member 44 positively determines the position of the blinders 38, e.g., a geared engagement between the actuating member and blinders 38.)

As mentioned above, detector 10 may be mounted on either a planar wall or an interior corner. In addition, the field of view of detector 10 may be adjusted to provide more effective coverage of the area. Referring first to FIGS. 1 and 2, the mounting and adjusting of detector 10 will now be described. To mount detector 10 on planar wall W, actuating member 44 is manually moved to the first member position shown in FIGS. 1 and 2. As a result, the actuating flange 46 engages actuating portion 40 of blinders 38 thereby pivoting blinders 38 to the first non-blinding position and providing field of view $V_1$ of approximately 180°. Field of view $V_1$ maximizes the horizontal area of coverage when the device is mounted to a planar wall W. Manually moving actuating member 44 to the first member position also exposes openings 18 (which are positioned for planar wall mounting) and covers openings 20, thereby indicating to user that the field of view is properly set for planar wall mounting and inhibit or prevent detector 10 from being mounted in an interior corner with the blinders in a position adapted for a wall mounting. Detector 10 may then be secured to the wall by inserting fasteners 24 into openings 18 and engaging fasteners 24 to wall W, as shown in FIG. 2.

To mount detector 10 in interior corner C actuating member 44 is manually moved to the second member position shown in FIGS. 3 and 4. As a result, the actuating flange disengages actuating portion 40 of blinders 38 to thereby permit the biasing member to bias blinders 38 to the second blinding position and provide field of view $V_2$ of approximately 90°. Field of view $V_2$ provides complete coverage of the area within interior corner C without intersecting the potential false alarm areas in the walls forming corner C. Consequently, false alarms generated by objects such as windows, curtains, and blinds are eliminated or reduced. Manually moving actuating member 44 to the second member position also exposes openings 22 (which are positioned for corner mounting) and covers at least one of openings 18, thereby alerting the user that the field of view is properly set for interior corner mounting and inhibit or prevent detector 10 from being mounted on a planar wall with the blinders being in a position adapted for a corner mounting.

It should be understood that the functions of the biasing member and actuating member 44 could be reversed. In other words, in an alternative embodiment the biasing member could be adapted to bias blinders 38 to the first non-blinding position, while the actuating member 44 affects the pivoting of blinders 38 to the second blinding position.

Although the above-described embodiment includes two PIR sensors, it is contemplated that the detector could include additional sensing devices such as a microwave radar detection device or additional PIR sensors. For example, turning now to FIGS. 5-6C, in another embodiment of the present invention the detector includes third PIR sensor 34 mounted on circuit board 26 above first and second sensors 28, 30. Third sensor 34 has a substantially horizontal line of sight and generates a horizontal field of view X defining an angle of approximately 90°, as illustrated in FIGS. 5B and 6B. A second or upper lens 36 is positioned over third sensor 34 and is adapted to provide third sensor 34 with at least one vertical detection zone $Z_3$, as shown in FIG. 7. First and second sensors 28, 30 have a downwardly directed line of sight and lens 32 is positioned over both first and second sensors 28, 30, and configured to provide first and second sensors with two vertical detection zones $Z_1$, $Z_2$, as illustrated in FIG. 7.

Figure 5:
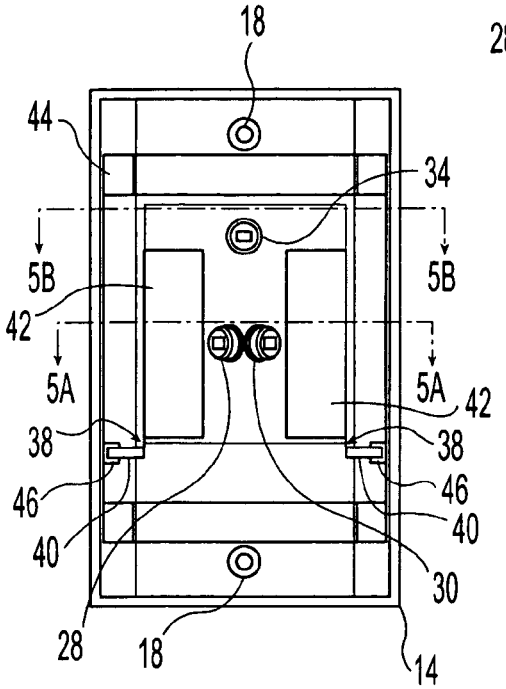
FIG. 5 is a front view of a detector with blinders according to another embodiment of the present invention, wherein the blinders are in a first position.
Figure 5A:
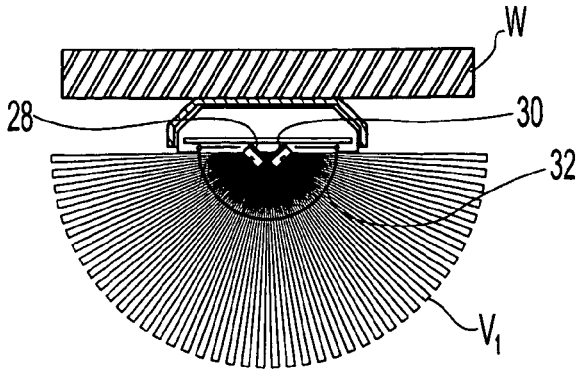
FIG. 5A is a lower sectional view, taken along lines 5A-5A, of the detector in FIG. 5 mounted on a planar wall.
Figure 5B:
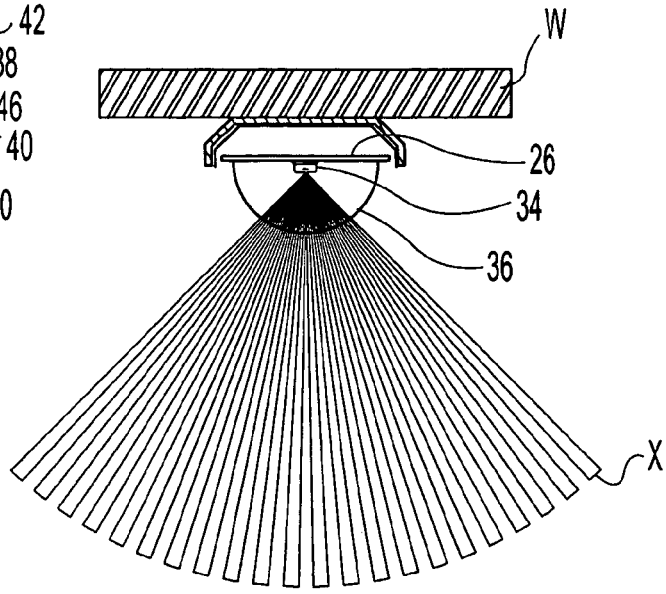
FIG. 5B is an upper sectional view, taken along lines 5B-5B, of the detector in FIG. 5 mounted on a planar wall.
Figure 5C:
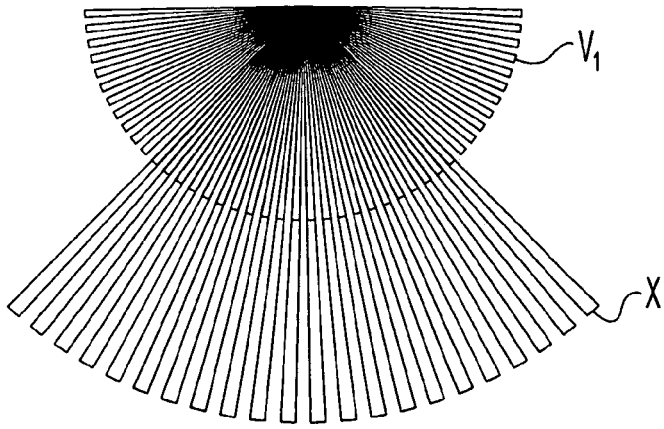
FIG. 5C is a top view of the horizontal field of view of the detector in FIG. 5.
Figure 6:
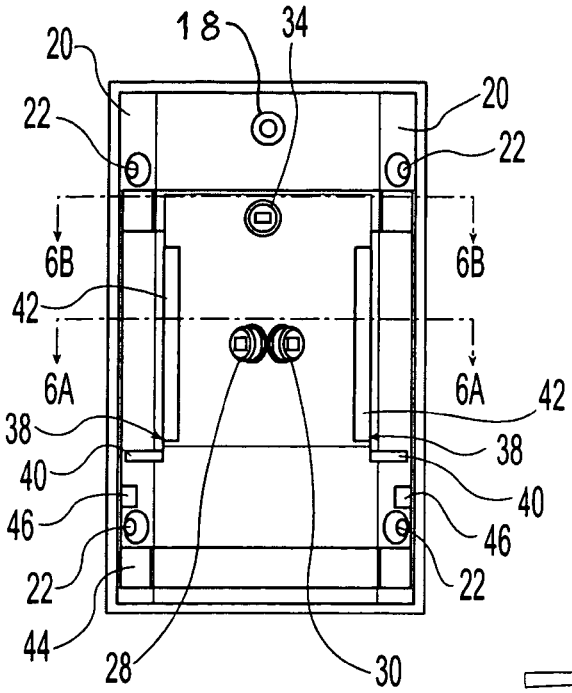
FIG. 6 is a front view of the detector of FIG. 5, wherein the blinders are in a second position.
Figure 6A:
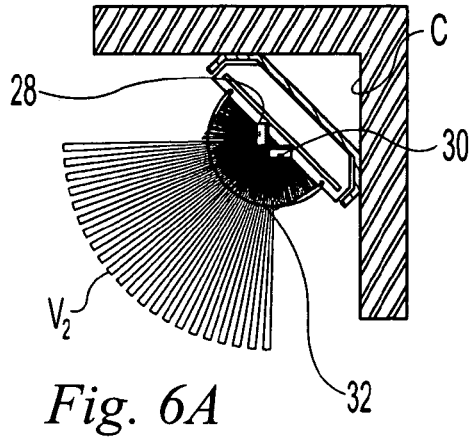
FIG. 6A is a lower sectional view, taken along lines 6A-6A, of the detector in FIG. 6 mounted on an interior corner.
Figure 6B:
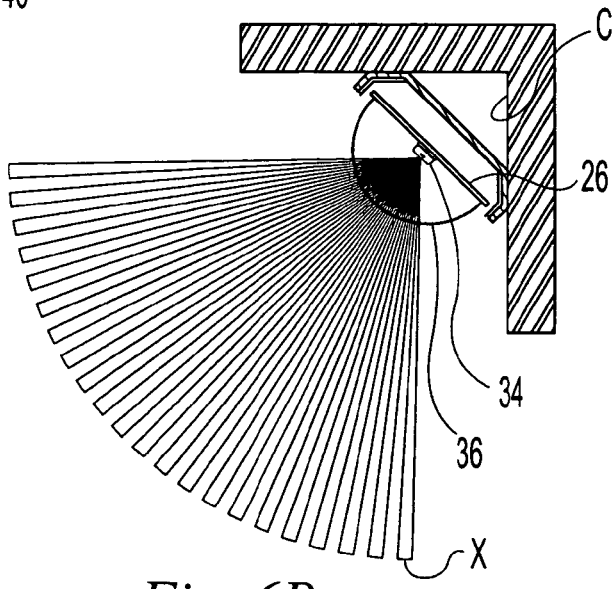
FIG. 6B is an upper sectional view, taken along lines 6B-6B, of the detector in FIG. 6 mounted on an interior corner.
Figure 6C:
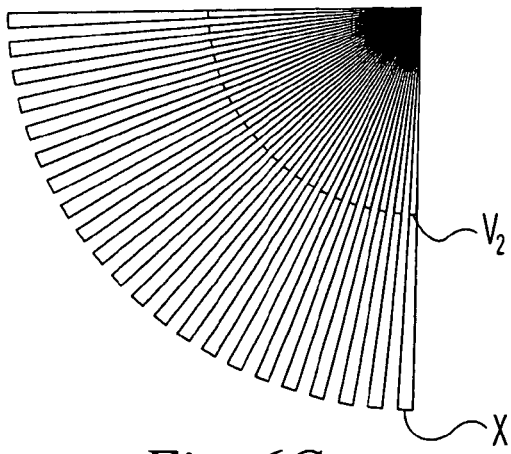
FIG. 6C is a top view of the horizontal field of view of the detector of FIG. 6.
Figure 7:
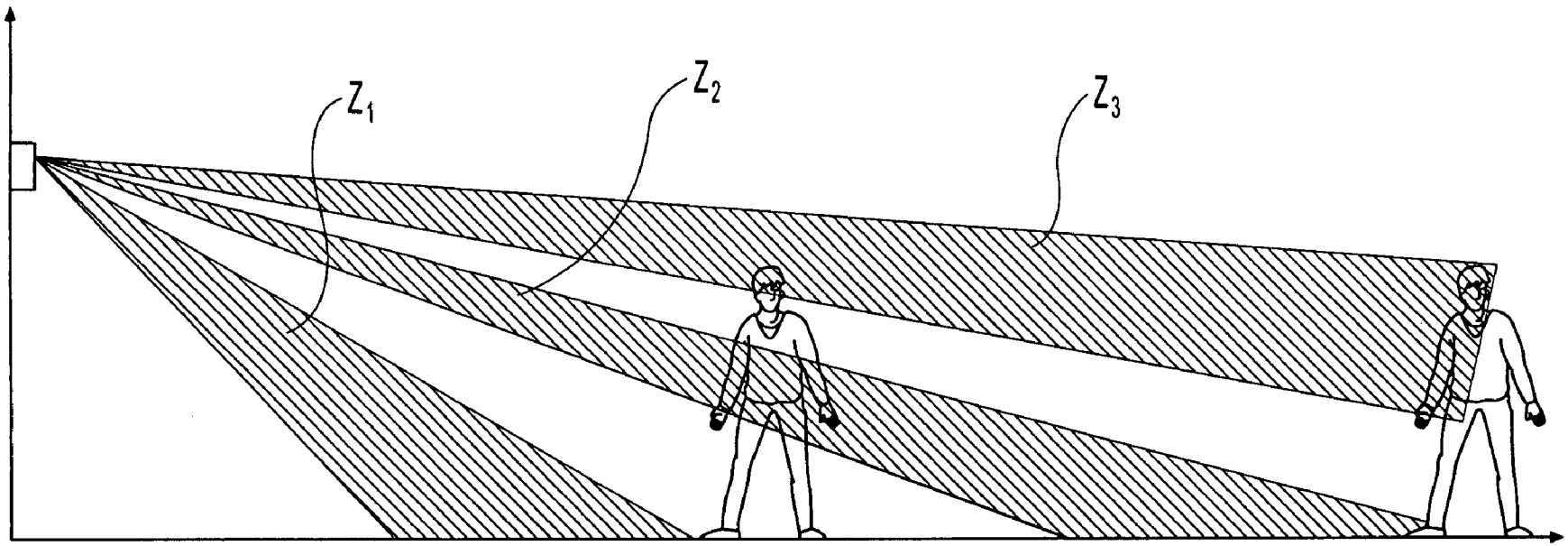
FIG. 7 is a side schematic view of the detector of FIG. 5 and its vertical detection zones.

To mount the detector of FIGS. 5-6C on a planar wall W, actuating member 44 is moved to the first member position shown in FIGS. 5 and 5A. As a result, openings 18 are revealed and blinders 38 move to the first non-blinding position as described in the previous embodiment, thereby providing first and second sensors 28, 30 with the maximized field of view $V_1$. FIG. 5C illustrates that the total horizontal coverage of the detector when mounted on the planar wall includes combined field of view $V_1$ of first and second sensors 28, 30 and field of view X of third sensor 34.

To mount the detector on an interior corner C, actuating member 44 is moved to the second member position shown in FIGS. 6 and 6A. As a result, openings 22 are revealed and blinders 38 move to the second blinding position, as described in the previous embodiment, thereby providing first and second sensors 28, 30 with reduced field of view $V_2$. Blinders 38 do not obstruct the field of view of third sensor 34 and, thus, third sensor 34 provides field of view X, shown in FIG. 6B. FIG. 6C illustrates that the total horizontal coverage of the detector when mounted on an interior corner includes combined field of view $V_2$ of first and second sensors 28, 30 and field of view X of third sensor 34.

The embodiments illustrated thus far have been adapted for both planar wall mounting and interior corner mounting. It should be understood, however, that the present invention could be mounted in exterior corners. In addition, rather than employing a biasing member to bias the blinders to one of the two positions, actuating member may be adapted to pivot blinders back and forth between the two positions and positively position the blinders. Furthermore, rather than providing only two different fields of view, the actuating member and blinders may be adapted to provide a continuum of blinder positions and, thus, a continuum of fields of view. In this form the detector is adjustable to accommodate not only a corner forming a right angle, but also corners having other angles.

As illustrated and described, the present invention provides a detector capable of being mounted on either a planar wall or an interior corner and having an adjustable field of view to facilitate effective detection coverage while minimizing false alarms. Moreover, the device is configured to inhibit the blinders from being in the wrong position when mounted in either a corner or on a wall. Thus, when fasteners are used to secure the device to a planar wall, the actuating member must be moved to place the blinders in the appropriate position for mounting on a planar wall to allow for insertion of the fasteners and the attachment features for mounting the device in a corner are unaccessible when the blinders are positioned for wall mounting. Similarly, when fasteners are used to secure the device in a corner, the actuating member must be moved to place the blinders in the appropriate position for mounting in a corner to allow for the insertion of the fasteners and the attachment features for mounting the device on a planar wall are unaccessible when the blinders are positioned for corner mounting.

Figure 8:
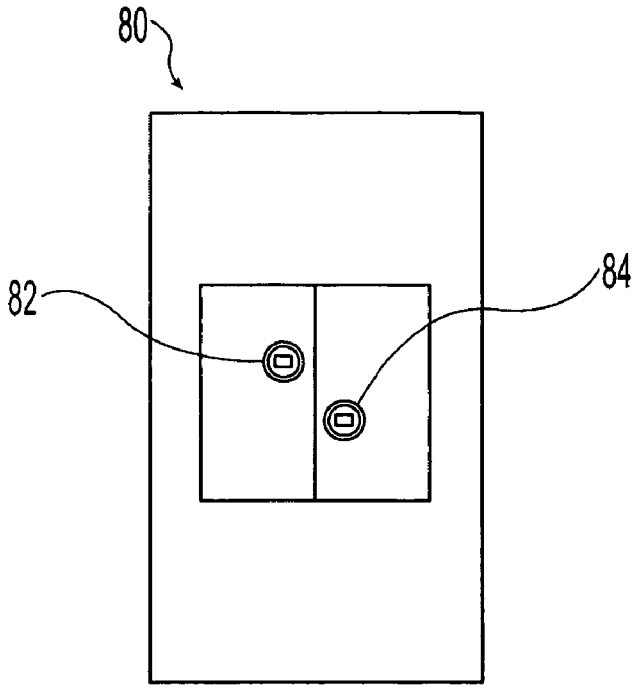
FIG. 8 is a schematic front view of another embodiment of the present invention.
Figure 8A:
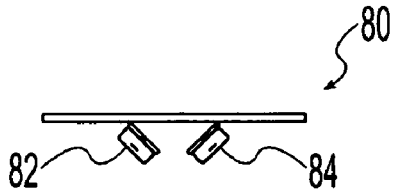
FIG. 8A is a top view of the embodiment of FIG. 8 with the sensors in a first position.
Figure 8B:
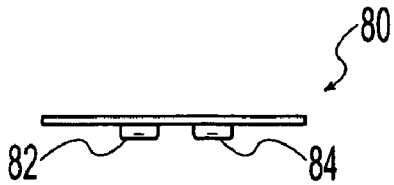
FIG. 8B is a top view of the embodiment of FIG. 8 with the sensors in a second position.

Another embodiment of the invention is schematically represented in FIGS. 8, 8A and 8B. In this embodiment, the detector assembly 80 includes a first sensor 82 and a second sensor 84 wherein each of the sensors have a horizontal field of view of approximately 90 degrees, e.g., the sensors may have a field of view of 85 degrees. Instead of utilizing moveable blinders to alter the combined horizontal field of view of the two sensors 82, 84, the sensors themselves are repositionable as illustrated by FIGS. 8A and 8B. In FIGS. 8 and 8B, the sensors are in a position wherein the two fields of view defined by sensors 82, 84 are substantially overlapping and define a combined field of view of approximately 90 degrees. In the position shown in FIG. 8A, the two fields of view of the defined by the sensors will be substantially non-overlapping and define a combined field of view of approximately 180 degrees.

In yet other embodiments of the invention, a portion of the housing may be positioned to restrict the field of view of one or more of the sensors to define, or limit, the horizontal field of view of the sensors in one or more of the positions of the sensors.

While this invention has been described as having an exemplary design, the present invention may be further modified within the spirit and scope of this disclosure. This application is therefore intended to cover any variations, uses, or adaptations of the invention using its general principles.

What is claimed is:

1. An intrusion detection system comprising:

first and second sensors, each of said first and second sensors having a horizontal field of view;

a housing, said first and second sensors being mounted within said housing, said first and second sensors being moveable relative to each other to define first and second relative positions wherein, when said first and second sensors are in said first relative position with respect to each other, said first and second sensors define a combined horizontal field of view having a first angle and wherein, when said first and second sensors are in said second relative position with respect to each other, said first and second sensors define a combined horizontal field of view having a second angle less than the first angle, and in said first relative position said horizontal fields of view of said first and second sensors are substantially overlapping and in said second relative position said horizontal fields of view of said first and second sensors are substantially non-overlapping; and a biasing member biasing said sensors towards one of said first and second relative positions.

2. The intrusion detection system of claim 1 wherein said biasing member biases said sensors towards said second relative position.

3. The intrusion detection system of claim 1 wherein the first angle is approximately 180 degrees and the second angle is approximately 90 degrees.

4. An intrusion detection system comprising:

first and second sensors positioned to provide a horizontal field of view;

at least one blinder having a first position wherein said first and second sensors have a first horizontal field of view defining a first angle and a second position wherein said first and second sensors have a second horizontal field of view defining a second angle less than the first angle;

a biasing member biasing said blinder toward a first one of said first and second positions;

a positioning member having a first member position and a second member position, said positioning member biasing said blinder toward the other of said first and second positions when said positioning member is in said first member position and wherein said biasing member biases said blinder into said first one of said first and second positions when said positioning member is in said second member position; and a housing mountable to either an interior corner or a planar wall, said housing having a first attachment element for securing said housing to a planar wall and a second attachment element for securing said housing to an interior corner, securement of said housing to a planar wall with said first attachment element disposing said positioning member in one of said first member position and said second member position, securement of said housing to an interior corner with said second attachment element disposing said positioning member in the other of said first member position and said second member position.

5. The intrusion detection system of claim 4 wherein said first attachment element comprises a set of first openings in said housing and said second attachment element comprises a set of second openings in said housing.

6. The intrusion detection system of claim 4 wherein the first angle is approximately 180 degrees and the second angle is approximately 90 degrees.

7. An intrusion detection system comprising:

first and second sensors, each of said first and second sensors having a downwardly directed line of sight and positioned to provide a horizontal field of view defining an angle of approximately 180 degrees;

a third sensor having a line of sight oriented substantially horizontally and having a horizontal field of view defining an angle of approximately 90 degrees; and at least one blinder having a first position for causing said third sensor to have a substantially unobstructed horizontal field of view and said first and second sensors to have a horizontal field of view defining an angle of at least about 180 degrees, and a second position for causing said third sensor to have a substantially unobstructed horizontal field of view and said first and second sensors to have a horizontal field of view defining an angle of approximately 90 degrees.

8. A method of adjusting the detection field of an intrusion detection system:

providing a first sensor and a second sensor, each of the first and second sensors having a horizontal field of view of approximately 90 degrees, the first and second sensors disposed within a housing and wherein the first and second sensors and the housing are positionable relative to each other to define a first horizontal field of view of approximately 90 degrees and a second horizontal field of view of approximately 180 degrees;

mounting the housing in one of a first and second location, the first location being in a corner and the second location being on a planar wall; and automatically positioning the first and second sensors and housing relative to each other based on the mounting location of the housing to define a horizontal field of view of approximately 90 degrees when the housing is mounted the first location and positioning the first and second sensors and housing relative to each other to define a horizontal field of view of approximately 180 degrees when the housing is mounted in the second location.

9. The method of claim 8 further including the step of generating an alarm signal when one of the first and second sensors detects an intruder.

10. A detection system comprising:

a housing having a first attachment element to secure the housing to a planar wall and a second attachment element to secure the housing to a corner;

at least one sensor located in the housing, the at least one sensor being positioned to provide a field of view; and means for automatically adjusting the field of view of the at least one sensor from a first field of view having a having a first angle when the first attachment element is used to secure the housing to a planar wall to a second field of view having a having a second angle different from the first angle when the second attachment element is used to secure the housing to the corner.

11. The detection system of claim 10 wherein the first angle is larger than the second angle.

12. The detection system of claim 10 wherein the adjusting means comprises at least one blinder movable relative to the at least one sensor between a first position to provide the first field of view and a second position to provide the second field of view.

13. The detection system of claim 12 wherein the adjusting means further comprises a biasing member configured to bias the at least one blinder toward a first one of the first and second positions.

14. The detection system of claim 13 wherein the adjusting means further comprises a positioning member having a first member position and a second member position, the positioning member biasing the at least one blinder toward the other of the first and second positions when the positioning member is in the first member position and wherein the biasing member biases the at least one blinder into the first one of the first and second positions when the positioning member is in the second member position.

15. The detection system of claim 10 wherein the adjusting means further comprises a positioning member having a first member position and a second member position, the positioning member being located in the first member position when the first attachment element is used to secure the housing to a planar wall to provide the first field of view, and the positioning member being located in the second member position when the second attachment element is used to secure the housing to the corner to provide the second field of view.

16. The detection system of claim 10 wherein system comprises first and second sensors and the adjusting means comprises a mechanism to provide relative movement between the first and second sensors to adjust the field of view between the first and second fields of view.

17. The detection system of claim 10 wherein the first attachment element comprises a set of first openings in the housing and the second attachment element comprises a set of second openings in the housing.

* * * * *